United States Patent [19]

Röck

[11] Patent Number: 4,488,762

[45] Date of Patent: Dec. 18, 1984

[54] DRAWER GUIDE ASSEMBLY

[75] Inventor: Erich Röck, Höchst, Austria

[73] Assignee: Julius Blum Gesellschaft m.b.H., Höchst, Austria

[21] Appl. No.: 382,351

[22] Filed: May 26, 1982

[30] Foreign Application Priority Data

Jul. 13, 1981 [AT] Austria ..... 3073/81

[51] Int. Cl.[3] ..... A47B 88/16

[52] U.S. Cl. ..... 312/348; 308/3.6; 312/330 R; 312/332; 312/341 R

[58] Field of Search ..... 312/332, 348, 341, 344, 312/330 R; 308/3.6; 108/143, 83

[56] References Cited

U.S. PATENT DOCUMENTS 4,057,303 11/1977 Röck et al. ..... 308/3.6
4,089,567 5/1978 Röck et al. ..... 308/3.6
4,255,002 3/1981 Röck et al. ..... 308/3.6
4,274,689 6/1981 Vander Ley et al. ..... 312/341 R

FOREIGN PATENT DOCUMENTS 348706 2/1979 Austria .
352321 9/1979 Austria .
356315 4/1980 Austria .

*Primary Examiner*—William E. Lyddane
*Assistant Examiner*—Thomas A. Rendos
*Attorney, Agent, or Firm*—Wenderoth, Lind & Ponack

[57] ABSTRACT

A pull out guide for drawers includes a stationary rail and a slideable rail on each side of the drawer. A mobile roller carrier is placed between each pair of rails. The roller carriers carry rollers that transmit the weight from the slideable rails to the stationary rails. The roller carriers are resiliently bendable by the slideable rails when the drawer is taken completely out of the cabinet and when it again is introduced into the cabinet.

2 Claims, 3 Drawing Figures

DRAWER GUIDE ASSEMBLY

FIELD OF THE INVENTION

Background Of The Invention

A pull-out device for each of opposite sides of drawers or the like includes one supporting rail and one guide rail, one of the rails being fastened to the body and the other to the drawer, and at least two rollers supporting the two rails against each other and exclusively serving for load transmission. The rollers are spaced from each other in the pull-out direction and are mounted on opposite sides of a load-transmitting flange of the guide rail in a carrier of a bendable material. Safety means prevents the carrier from being extracted from the supporting rail, and is in the form of an outwardly projecting member provided on one sliding side of the carrier and a pressure member provided on the side of the carrier opposite to the projecting member. The pressure member coacts with a stop member of the supporting rail, when the guide rail if fully pulled-out from the carrier, to make the carrier on the side provided with the projecting member movable towards the supporting rail such that the projecting member engages into a punched hole in the supporting rail.

DESCRIPTION OF THE PRIOR ART

Pull-out guides of this kind are frequently used for drawers but also for shelves and the like in modern furniture construction, particularly in the construction of kitchen furniture. An essential feature of pull-out guides of this kind is that the carrier must be locked in its supporting rail when the drawer has been removed, so that the carrier is prevented from unintentionally rolling backwards or forwards.

A prior art pull-out guide provides that the carrier, when the guide rail and the drawer are removed from the carrier, is pressed downwards by a resilient pressure member, whereby a projecting member is pressed into a punched hole in the supporting rail.

When inserting the drawer, the carrier is lifted by means of the guide rail against the spring pressure of the pressure member, which is injection moulded to the carrier in the form of a resilient flap, and the projecting member is pulled out from the punched hole.

A further embodiment of a prior art carrier provides that the carrier is formed in one piece of injection moulded plastic material, but has three functional areas.

This carrier is provided with projections on its upper and lower sides, such projections engaging in recesses of the supporting or the pull-out rail, when the carrier is in the locked position, depending on the rail in which the carrier is guided.

The three functional areas comprise two external rigid areas and a central area which is formed by two spring tongues. By means of such tongues, one of which is a bracing or tensioning element, the carrier is folded up in the center in the region of these tongues when the drawer is removed from the body and the carrier is in touch with one rail only, whereby the projections are pressed into the recesses.

It is a disadvantage of the above-described arrangements that the safe engagement or locking of the carrier always depends on a resilient structural member. After long use, this member may naturally be worn, which substantially impairs the function of the entire pull-out guide assembly. This is particularly true for the latter-mentioned embodiment in which the resilient or bracing element is continuously tensioned during normal use of the drawer.

SUMMARY OF THE INVENTION

It is the object of the invention to provide a one-piece carrier which is safety anchored in a rail when the drawer is removed completely from the body, whereby such anchoring is exclusively effected by the motion of the drawer rails.

Accordingly to the invention, this is achieved by providing the guide rail with an abutment member and the carrier with a corresponding stop surface, the abutment member pressing on such stop surface when the drawer is being inserted or removed, and wherein the carrier is tension-free in the normal sliding position as well as in the locked position with the drawer removed and is bendable by means of the abutment member of the guide rail only during removal or insertion of the drawer.

Preferably, those areas of the carrier which bend are formed by reduced quantities of material.

BRIEF DESCRIPTION OF THE DRAWINGS

In the following, an embodiment of the invention will be described in more detail with reference to the attached drawings, without being limited thereto, and wherein.

DESCRIPTION OF THE PREFERRED EMBODIMENT

Figure 1:
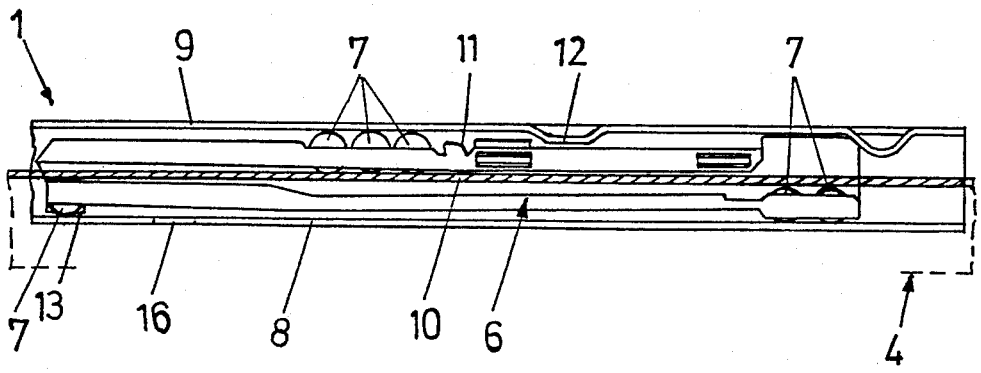
FIG. 1 is a schematic side view of a pull-out guide assembly according to the invention in the region of the carrier, the carrier being in the sliding position.

The pull-out guide of the present invention comprises a supporting rail 1 with a U-shaped profile in which a carrier 6 runs and a guide rail 4 with a Z-shaped profile which is inserted into the carrier 6. The supporting rail 1 can be mounted on the side of the body of a finished piece of furniture by being fastened to the furniture side wall. It can equally be arranged on a side wall of a drawer, particularly when used with plastic drawers. The carrier 6 is of a bendable material, preferably of plastic material, and includes rollers 7 mounted in a triangular arrangement, such that two groups of rollers run on a lower flange 8 of the supporting rail, whereas a third group of rollers, which in the illustrated embodiment is formed by three rollers 7, rests against an upper flange 9 of the supporting rail 1.

When the drawer is in the inserted position, a load-transmitting flange 10 of the guide rail 4 is inserted into the carrier 6 such that it rests on the two lower groups of rollers, whereas the third group of rollers, which with respect to the depth of the body is arranged between the two lower groups of rollers, runs on the upper side of flange 10. The guide rail 4 thus is secured from tilting with respect to the vertical.

When the drawer is pulled out and, hence, the guide rail 4 is moved in the direction of arrow A, initially the carrier 6 is moved as well. In the extreme pull-out position, a pressure member 11 of carrier 6 moves below a stop member 12, which is a projection from the upper flange 9 of the supporting rail 1.

In the illustrated embodiment, the stop member 12 is provided on the free edge of the upper flange 9 of the supporting rail and, hence, also forms a safety means against lateral tilting of the carrier 6 when the drawer is in the pulled-out position, as stop member 12 laterally engages over the flange.

Moreover, a stop 14 provided on the supporting rail 1 prevents the carrier from being fully extracted from the supporting rail.

Figure 2:
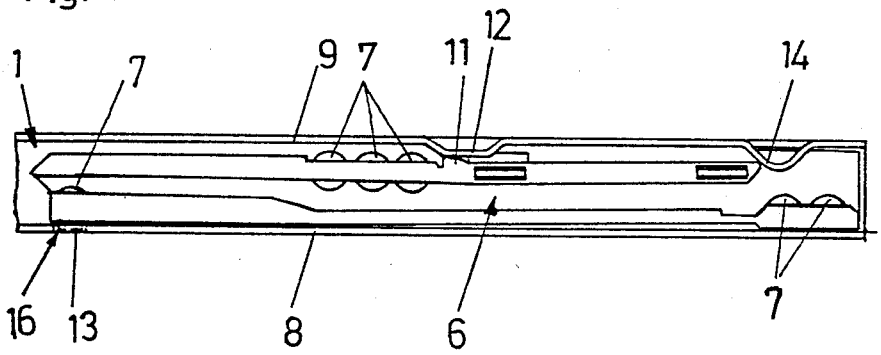
FIG. 2 is a similar view, the carrier being in the locked position.

Horizontal flange 10 of guide rail 4 includes an abutment member 15 which operates to bend the body of carrier 6 only during removal of the guide rail 4 from and insertion of the guide rail 4 into the carrier body. Thus, during the normal sliding position of the elements, abutment member 15 will be in a position to the left of carrier 6 as viewed in the drawings, i.e. such that abutment member 15 does not contact the carrier. Upon the carrier 6 being moved to the position shown in FIG. 3 such that pressure member 11 abuts stop member 12, with projection 13 being extended through hole 16, movement of the guide rail 4 from the normal position will cause abutment member 15 to contact a surface 17 of the body of carrier 6. This will cause the carrier body to bend by an amount sufficient to remove the projection 13 from hole 16. Upon full removal of the guide rail 4 from the carrier body, this bending tension of course will be removed, such that projection 13 then extends into hole 16, thereby locking the carrier 6 within supporting rail 1 as shown in FIG. 2. Thus, guide rail 4 together with the drawer can be completely removed from the carrier 6, or alternatively the carrier 6 together with the supporting rail 1 and the drawer can be removed from the furniture body. In either case, the carrier 6 remains locked in the position shown in FIG. 2, i.e. the carrier 6 is locked with supporting rail 1 by engagement of projecting member 13 into hole 16.

When the drawer is inserted again, the abutment member 15 is guided along surface 17 on the carrier 6, whereby the carrier is, as illustrated in FIG. 3, bent again, and the projecting member 13 is lifted from the punched hole 16.

Then, the carrier 6 can be moved in the direction of arrow B. When the carrier 6 with its pressure member 11 moves out from below the stop member 12, the carrier 6 is no longer in bent condition, and the carrier is again guided without tension between the supporting rail 1 and the guide rail 4.

Figure 3:
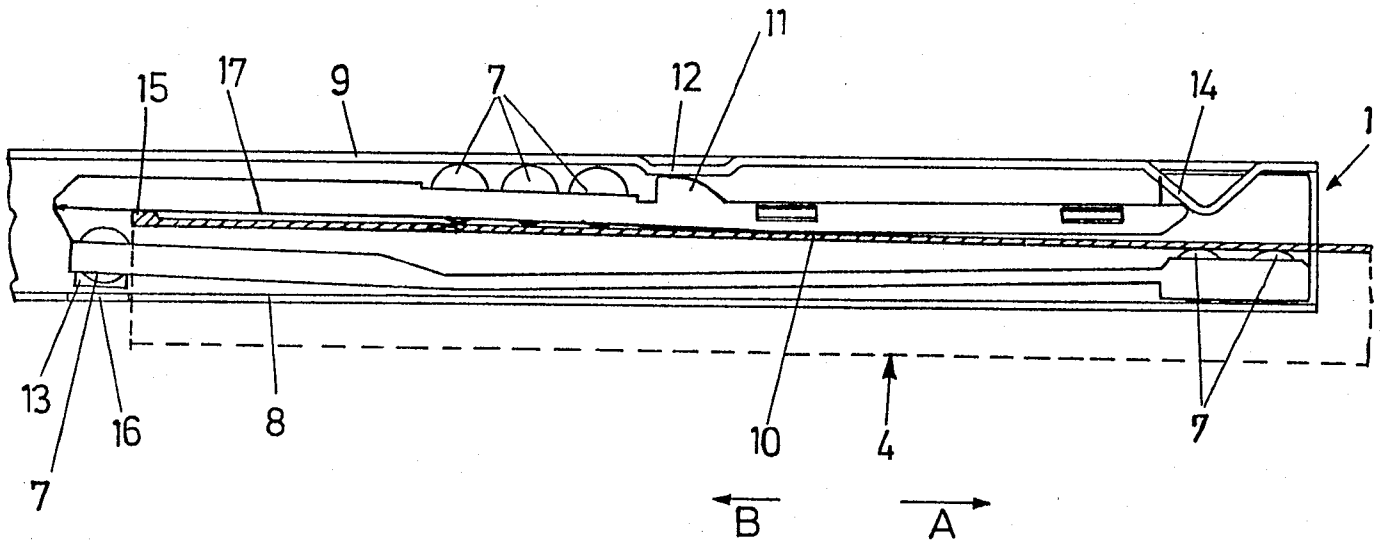
FIG. 3 is a similar view of the same position when the drawer is being inserted or taken out.

As already mentioned, when the drawer has been taken out, i.e. when it is in the position illustrated in FIG. 2, the carrier is also retained in the supporting rail 1 without tension. Only when the drawer is being inserted and taken out, as illustrated in FIG. 3, is the carrier 6 bent by the guide rail 4.

What is claimed is:

1. A pull out guide assembly for use on each of opposite sides of a drawer or the like in an article of furniture of the type wherein the drawer or the like is slidably insertable into and removable from a furniture body, said assembly comprising:

a supporting rail adapted to be fastened to one of the drawer or the like or the furniture body;

a guide rail adapted to be fastened to the other of the drawer or the like or the furniture body, said guide rail including a load transmitting flange;

at least two rollers positioned between and in rolling contact with said guide and supporting rails and providing exclusive load transmission therebetween, said rollers being spaced from each other longitudinally of said rails;

said rollers being mounted on opposite sides of said load transmitting flange by means of a carrier which is movable with respect to said supporting and guide rails during normal sliding movement of the drawer or the like;

said carrier comprising an elongated body formed of a material enabling bending of said body in a direction transverse to the longitudinal direction thereof and of said rails;

means for, upon the drawer or the like being removed completely from the furniture body, preventing said carrier from being removed from said supporting rail upon removal of said guide rail therefrom, said preventing means comprising a projection extending from one side of said carrier and adapted to extend through a hole in said supporting rail, and a pressure member extending from an opposite side of said carrier and adapted to abut a stop member on said supporting rail, thereby to tilt said carrier such that said projection extends into said hole, thus locking said carrier in said supporting rail;

said carrier body being in an untensioned and nonbent condition when said carrier is in said locked position and when said carrier is in a normal position slidable with respect to said rails; and means for bending said carrier body from said untensioned condition only during removal of said guide rail from and insertion of said guide rail into said carrier, said bending means comprising an abutment member extending from said guide rail and cooperable with a surface of said carrier body such that when said pressure member abuts said stop member said abutment member acts on said surface and bends said carrier body by an amount sufficient to remove said projection from said hole, said abutment member not being in contact with said surface when said carrier is in said normal position slidable with respect to said rails.

2. An assembly as claimed in claim 1, wherein those areas of said carrier body which bend are formed of quantities of material reduced with respect to the remainder of said carrier body.

* * * * *